US005881884A

United States Patent [19]

Podosek

[11] Patent Number: 5,881,884

[45] Date of Patent: Mar. 16, 1999

[54] SHIPPING AND DISPLAY CARTON AND BLANK THEREFOR

[75] Inventor: Edward Podosek, Wilbraham, Mass.

[73] Assignee: Avery Dennison Corporation, Pasadena, Calif.

[21] Appl. No.: 816,092

[22] Filed: Mar. 13, 1997

[51] Int. Cl.[6] ..... B65D 5/54

[52] U.S. Cl. ..... 206/774; 206/736; 229/242

[58] Field of Search ..... 206/736, 738, 206/745, 746, 774, 775, 769; 229/241, 242

[56] References Cited

U.S. PATENT DOCUMENTS

| | | | |
|---|---|---|---|
| 1,925,102 | 9/1933 | Levkoff . | |
| 2,131,391 | 9/1938 | Schraffenberger . | |
| 2,152,079 | 3/1939 | Mott . | |
| 2,420,773 | 5/1947 | Dorfman . | |
| 2,675,913 | 4/1954 | Hanson . | |
| 2,723,026 | 11/1955 | Paige . | |
| 2,947,637 | 8/1960 | Fobiano . | |
| 3,228,582 | 1/1966 | Osberg | 229/242 |
| 3,263,861 | 8/1966 | Carr | 229/242 |
| 3,653,495 | 4/1972 | Gray . | |
| 3,917,158 | 11/1975 | Dorofachuk et al. | 229/241 |
| 4,000,811 | 1/1977 | Hardison et al. | 206/503 |
| 4,058,206 | 11/1977 | Morse et al. . | |
| 4,553,666 | 11/1985 | Gullikson . | |
| 4,905,837 | 3/1990 | Schuster et al. | 229/120.011 |
| 4,946,042 | 8/1990 | Ferreri et al. | 229/242 |
| 4,978,009 | 12/1990 | Pany . | |
| 5,181,650 | 1/1993 | Hollander et al. . | |
| 5,582,345 | 12/1996 | Lankhuijzen | 229/242 |

*Primary Examiner*—Paul T. Sewell
*Assistant Examiner*—Luan K. Bui
*Attorney, Agent, or Firm*—Kriegsman & Kriegsman

[57] ABSTRACT

A carton for use in the shipping and display of a plurality of articles comprises a single-piece blank cut and scored to include a top panel, a right side panel, bottom panel and a left side panel foldably connected together to form a box-shaped configuration with an open front and an open back. The blank also includes four front flaps, one front flap being foldably connected to each of the panels so as to close the open front of the carton when folded. The blank further includes four back flaps, one back flap being foldably connected to each of the panels so as to close the open back of the carton when folded. Formed in the left side panel and in the front flap connected to the left side panel is a first perforated tear line. Formed in the right side panel and in the front flap connected to the right side panel is a second perforated tear line. First and second perforated tear lines enable the carton to be severed along the tear lines to covert the carton for display of the plurality of articles.

4 Claims, 3 Drawing Sheets

SHIPPING AND DISPLAY CARTON AND BLANK THEREFOR

BACKGROUND OF THE INVENTION

The present invention relates generally to cartons for use in shipping a plurality of articles and more particularly to carton for use in shipping a plurality of articles which can be converted to display the plurality of articles contained therewithin.

It is a well known practice to employ cartons to package, store and transport sales articles from the manufacturer to the place of sale, such as a retail store. Conventionally, cartons, also referred to as containers, are formed from a one-piece blank made of corrugated paperboard which is suitably cut, scored and folded to produce a generally rectangularly shaped box. Once the carton reaches the place of sale, the articles held therewithin are unpackaged from the carton and are typically placed on display shelves.

One drawback of such cartons is that a significant amount of labor is required to remove the articles from the carton and, in turn, place them on the display shelves.

Accordingly, it is well known in the art for cartons which can be utilized to ship the plurality of sales articles to be convertible into a display device at the place of sale, thereby eliminating the labor required in transferring the articles from the carton to the shelves of the place of sale. Such cartons normally comprise a separable upper section which is torn away from the lower section by a tear strip or perforated tear line formed through panels of the carton to expose the packaged articles for display.

In U.S. Pat. No. 4,553,666 to Gullikson, there is disclosed a shipping and display carton with cut protection for contents. The shipping and display carton can be used for a plurality of plastic containers. The carton is formed from a flat blank that is folded into a slotted style container configuration with end flaps of sufficient size to effectively close the ends of the tubular configuration with a double thickness of corrugated board. A diagonal, perforated line is made in the underlying flaps and a diagonal cut designating line is marked on the overlying flaps. The cut designating line is also marked across the width of both the front panel and back panel joining the ends of the cut designating lines in the flaps. A small panel extends under the front panel cut designating line to protect the enclosed product. After the cut designating line has been cut, the carton is separated into two parts with the upper part discarded and the lower part serves as the display.

In U.S. Pat. No. 4,058,206 to Morse et al there is disclosed a display carton and blank therefor. The display carton comprises a one-piece blank cut and scored to form vertically disposed front, back and side panels and horizontally disposed top and bottom panels. A vertically disposed separate partition is further disposed intermediate the side panels and is attached to the front, back and bottom panels by lock tabs engaging accommodating slots formed through the panels. A continuous tear line is formed in the front, back, side, and top panels to divide the carton into a removable upper section and a lower section adapted to retain a plurality of upstanding packages therein for display purposes.

In U.S. Pat. No. 3,653,495 to Gray there is disclosed a shipping a display container in which the shipping container or carton has weakened portions which allow the container to divide into two display tray portions to display the plurality of articles therein.

Other patents of interest include U.S. Pat. No. 5,181,650 to Hollander et al, U.S. Pat. No. 4,978,009 to Pany, U.S. Pat. No. 2,947,637 to Fobiano, U.S. Pat. No. 2,723,026 to Paige, U.S. Pat. No. 2,675,913 to Hanson, U.S. Pat. No. 2,420,773 to Dorfinan, U.S. Pat. No. 2,152,079 to Mott, U.S. Pat. No. 2,131,391 to Schraffenberger and U.S. Pat. No. 1,925,102 to Levkoff.

SUMMARY OF THE INVENTION

It is an object of the present invention to provide a new and useful carton which can be used for shipping a plurality of articles.

It is another object of the present invention to provide a carton as described above which can be easily converted to enable it to be used for displaying the plurality of articles held therewithin.

It is yet another object of the present invention to provide a carton as described above which is formed from a single-piece blank.

It is still another object of the present invention to provide a carton as described above which is durable and strong.

It is yet still another object of the present invention to provide a carton as described above which is simple and inexpensive to manufacture.

A carton constructed according to the teachings of the present invention for use in the shipping and display of a plurality of articles, said carton comprising a top panel, a right side panel, bottom panel and a left side panel foldably connected together to form a box-shaped configuration with an open front and an open back, a first pair of front flaps, one of said first pair of front flap being foldably connected to each of said side panels, said first pair of front flaps being sized and shaped so as to close the open front of said carton when folded, a first pair of back flaps, one of said first pair of back flaps being foldably connected to each of said side panels, said first pair of back flaps being sized and shaped so as to close the open back of said carton when folded, a first tear line formed in said left side panel and in the front flap connected to said left side panel, and a second tear line formed in said right side panel and in the front flap connected to said right side panel, said first and second tear lines enabling said carton to be severed along said tear lines to covert said carton for display of the plurality of articles.

A blank constructed according to the teachings of the present invention for forming a carton, said blank being cut and scored to comprise a top panel, a right side panel, a bottom panel and a left side panel consecutively connected, four front flaps, one front flap being connected to each of said panels, four back flaps, one back flap being connected to each of said panels, a first tear line formed in said left side panel and in the front flap connected to said left side panel, and a second tear line formed in said right side panel and in the front flap connected to said right side panel.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration various embodiments for practicing the invention. The embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitutes a part of this specification, illustrate an embodiment of the invention and, together with the description, serve to explain the principles of the invention. In the drawings wherein like reference numerals represent like parts.

DETAILED DESCRIPTION OF A PREFERRED EMBODIMENT

Figure 1:
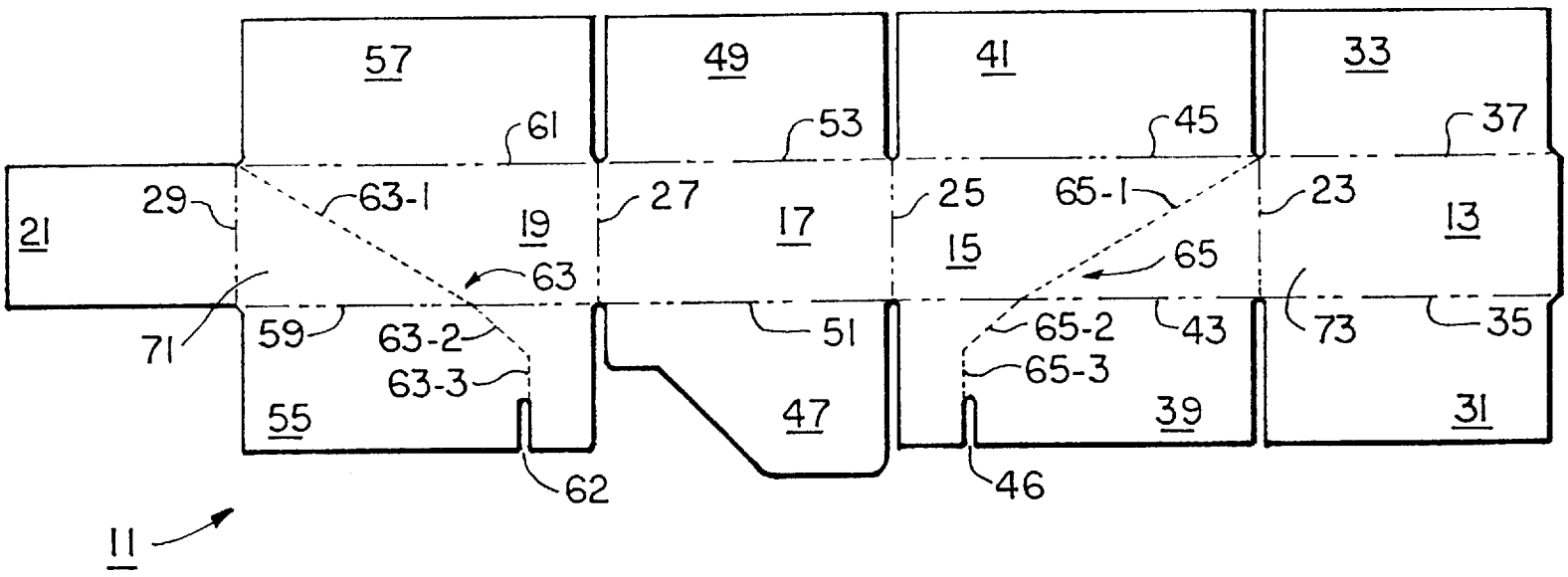
FIG. 1 is a top plan view of the inner face of the blank of the carton for shipping and display constructed according to the teachings of the present invention.

Referring now to FIG. 1, there is shown a top plan view of the inner face of a single-piece corrugated paperboard blank from which the preferred embodiment of a carton for shipping and display is formed, the preferred embodiment being constructed according to the teachings of the present invention and being identified generally by reference numeral 11.

As will be described in detail below, through a series of steps, the blank of the present invention can be formed into the carton for shipping of the present invention. Furthermore, through a series of steps, the carton for shipping of the present invention can be formed into the carton for display of the present invention. It should be noted that the preferred embodiment of the present invention, whether in its initial blank form or converted into the carton for shipping or the carton for display, is represented generally by reference numeral 11.

Blank 11 comprises a top panel 13, a right side panel 15, a bottom panel 17, a left side panel 19 and a glue flap 21. Top panel 13 is generally rectangular in shape and is hingedly connected to right side panel 15 by a scoreline 23. Right side panel 15 is generally rectangular in shape and is hingedly connected to bottom panel 17 by a scoreline 25. Bottom panel 17 is identical in size and shape to top panel 13 and is hingedly connected to left side panel 19 by a scoreline 27. Left side panel 19 is identical in size and shape to right side panel 15 and is hingedly connected to generally rectangular glue flap 21 by a scoreline 29. As will be hereinafter explained in detail, scorelines 23, 25, 27 and 29 are disposed in parallel relationship relative to each other to adapt blank 11 to be folded into the carton of the present invention, generally rectangular glue 21 flap serving to secure the shape of the carton.

Top panel 13 has a generally rectangular front flap 31 and a generally rectangular back flap 33 hingedly connected thereto by scorelines 35 and 37, respectively. Right side panel 15 has a generally rectangular front flap 39 and a generally rectangular back flap 41 hingedly connected thereto by scorelines 43 and 45, respectively. Generally rectangular front flap 39 is shaped to define an elongated slot 46 which extends in from its free edge and partially across the width of front flap 39. Bottom panel 17 has a multi-sided front flap 47 and a generally rectangular back flap 49 hingedly connected thereto by scorelines 51 and 53, respectively. Left side panel 19 has a generally rectangular front flap 55 and a generally rectangular back flap 57 hingedly connected thereto by scorelines 59 and 61, respectively. Generally rectangular front flap 55 is shaped to define an elongated slot 62 which extends in from its free edge and partially across the width of front flap 55. Scorelines 35, 43, 51 and 59 are linearly disposed such that front flaps 31, 39, 47 and 55 can together serve to close the front of carton 11 when prepared for shipping. Similarly, scorelines 37, 45, 53 and 61 are linearly disposed so that back flaps 33, 41, 49 and 57 can together serve to close the back of carton 11 when prepared for shipping.

Blank 11 further includes a first perforated tear line which is identified generally by reference numeral 63. First perforated tear line 63 comprises three perforated tear lines 63-1, 63-2 and 63-3 which have portions thereof superimposed over each other to form a continuous perforated line which extends across left side panel 19 and front flap 55. More specifically, tear line 63-1 starts at the approximate point of intersection of scorelines 29 and 61 and extends diagonally inward across left side panel 19 and terminates at its intersection with scoreline 59. Tear line 63-2 starts at the point of termination of tear line 63-1 and extends diagonally inward across a portion of front flap 55 and terminates directly above slot 62. Tear line 63-3 starts at the point of termination of tear line 63-2 and extends straight down, in parallel with scorelines 23, 25, 27 and 29, terminating into slot 62.

Blank 11 further includes a second perforated tear line which is identified generally by reference numeral 65. Second perforated tear line 65 comprises three perforated tear lines 65-1, 65-2 and 65-3 which have portions thereof superimposed over each other to form a continuous perforated line which extends across right side panel 15 and front flap 39. More specifically, tear line 65-1 starts at the approximate point of intersection of tearlines 23 and 45 and extends diagonally inward across right side panel 15 and terminates at its intersection with scoreline 43. Tear line 65-2 starts at the point of termination of tear line 65-1 and extends diagonally inward across a portion of front flap 39 and terminates directly above slot 46. Tear line 65-3 starts at the point of termination of tear line 65-2 and extends straight down, in parallel with scorelines 23, 25, 27 and 29, terminating into slot 46.

Figure 2:
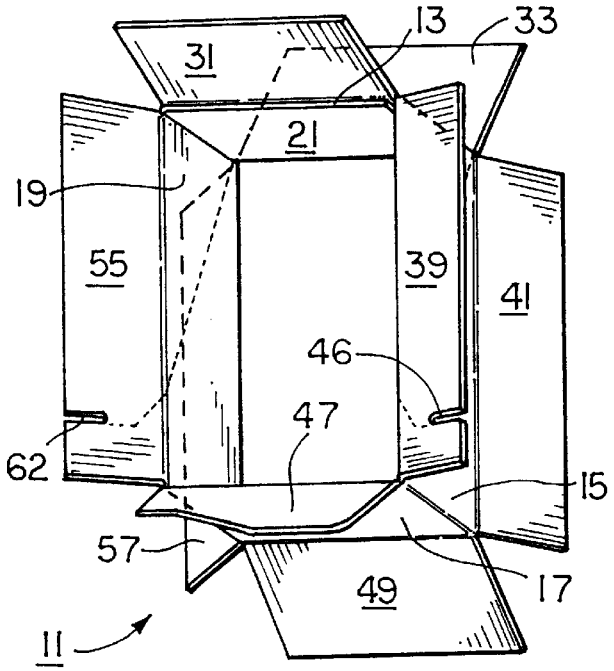
FIG. 2 is a front perspective view of the blank of FIG. 1 after being folded to form the carton for shipping of the present invention, the carton being shown with its front flaps and its back flaps in the open position.

Blank 11 can be formed into the carton for shipping of the present invention in the following manner. Left side panel 19 and right side panel 15 are folded up through scorelines 27 and 25, respectively, so as to extend perpendicularly relative to bottom panel 17. Glue tab extension 21 is folded down through scoreline 29 so as to extend perpendicularly to left side panel 19 and top panel 13 is folded down through scoreline 23 so as to extend perpendicularly relative to right side panel 15, top panel 13 lying on top of and in direct contact with glue tab 21 to form the four-sided box-shape configuration of carton 11. A portion of the outer surface of glue tab 21 has an adhesive, such as glue, applied thereto which contacts the underside of top panel 13 to secure the four-sided structure of carton 11, as shown in FIG. 2.

Figure 3:
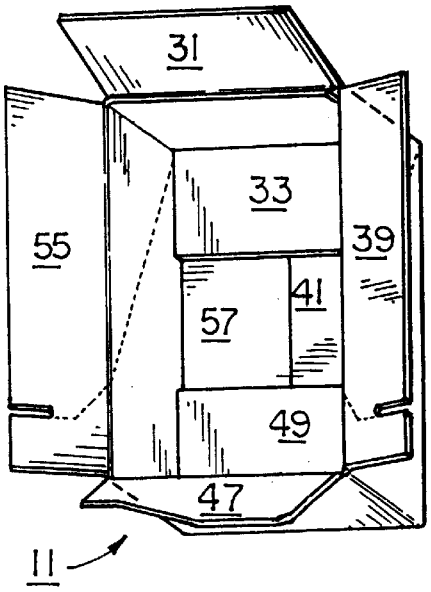
FIG. 3 is a front perspective view of the carton for shipping of FIG. 2, the carton being shown with its back flaps in the closed position.

Referring now to FIG. 3, to close the back of carton 11, back flaps 33 and 49 are folded closed through scorelines 37 and 53, respectively. Thereafter, back flaps 41 and 57 are folded closed through scorelines 45 and 61, respectively. Back flaps 41 and 57 are folded so as to extend perpendicularly relative to right side panel 15 and left side panel 19, respectively. Back flaps 41 and 57 are sized and shaped so as to completely cover the back of carton 11 when folded closed. With back flaps 41 and 57 folded closed to cover the back of carton 11, flaps 41 and 57 are secured in the closed position by an elongated adhesive strip 67 such as tape. Adhesive strip 67 extends along the entire length of the free ends of flaps 41 and 57 and is secured to a portion of top panel 13 and bottom panel 17 to effectively close the back of carton 11.

Figure 4:
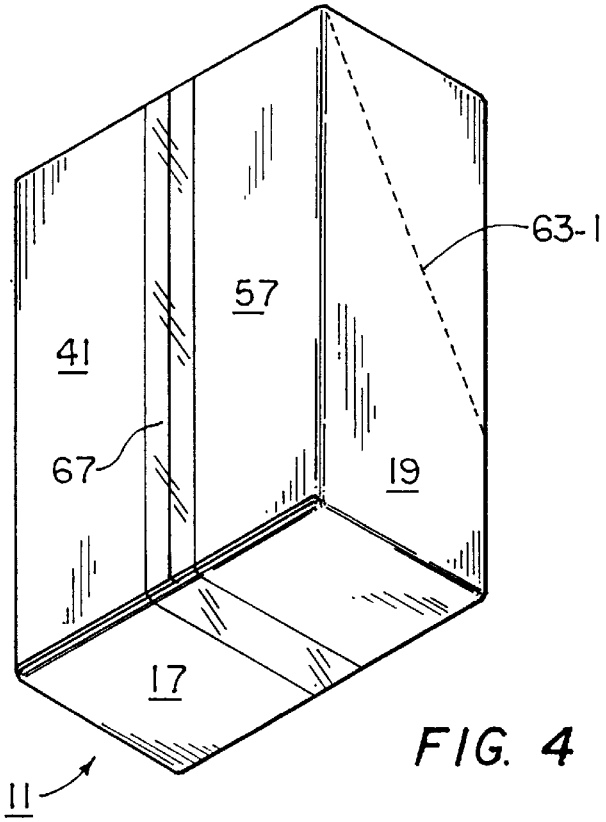
FIG. 4 is back, left side perspective view of the carton for shipping of FIG. 2, the carton being shown with its front flaps and its back flaps secured in the closed position by a strip of adhesive tape.
Figure 5:
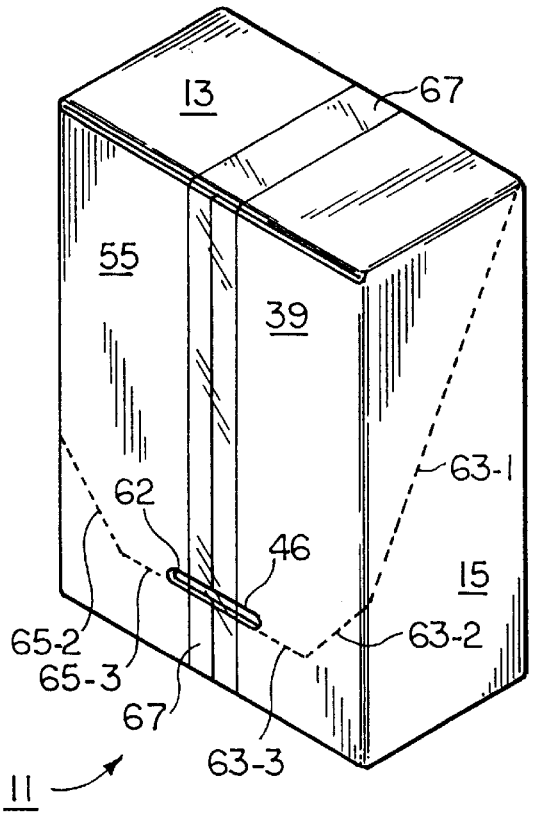
FIG. 5 is a front, right side perspective view of the carton for shipping of FIG. 4.

Carton 11, with its front still open, is now in a condition to be loaded with the particular articles to be shipped and displayed. After the particular articles have been loaded into carton 11, the front of carton 11 can be closed by first folding inward front flaps 31 and 47 through scorelines 35 and 51, respectively. Thereafter, front flaps 39 and 55 are folded closed through scorelines 43 and 59, respectively. Front flaps 39 and 55 are folded closed so as to extend perpendicularly relative to right side panel 15 and left side panel 19, respectively. Front flaps 39 and 55 are sized and shaped so as to completely cover the front of carton 11 when folded closed, with the exception being that slot 46 and slot 62 linearly align to form a single elongated slot in the front of carton 11. With front flaps 39 and 55 folded closed to cover the front of carton 11, flaps 39 and 55 are secured in the closed position by adhesive strip 67. Adhesive strip 67 extends along the entire length of the free ends of flaps 39 and 55 and is secured to a portion of top panel 13 and bottom panel 17 to effectively close the front of carton 11. It should be known that adhesive strip 67 is shown as a single elongated strip of tape which is wrapped entirely around carton 11 to close the front and the back of carton 11 for shipping; however, it is to be understood that the front and back of carton 11 could alternatively be closed by multiple strips of tape or other adhesive means. With its front and back closed, as shown in FIGS. 4 and 5, carton 11 is in its preferred form for shipping.

To convert carton 11 from its preferred form for shipping to its preferred form for displaying the articles contained therewithin, adhesive strip 67 is first cut laterally across its width at the junction of top panel 13 and back flaps 41 and 57, thereby 57 detaching back flaps 41 and 57 from top panel 13 but keeping back flaps 41 and 57 secured together. Adhesive strip 67 is then cut laterally across its width at the junction of top panel 13 and front flaps 39 and 55, thereby detaching front flaps 39 and 55 from top panel 13. Adhesive strip 67 is also cut laterally across its width through slots 46 and 62 to ensure that slots 46 and 62 are open.

Adhesive strip is next cut longitudinally along its length between the free ends of front panels 39 and 55 from the junction of top panel 13 and front flaps 39 and 55 down and across slots 46 and 62. The remainder of adhesive strip 67 on the front of carton 11 which secures front panels 39 and 55 together from slots 46 and 62 down to the junction of bottom panel 17 and front flaps 39 and 55 remains secured and is not severed.

Figure 6:
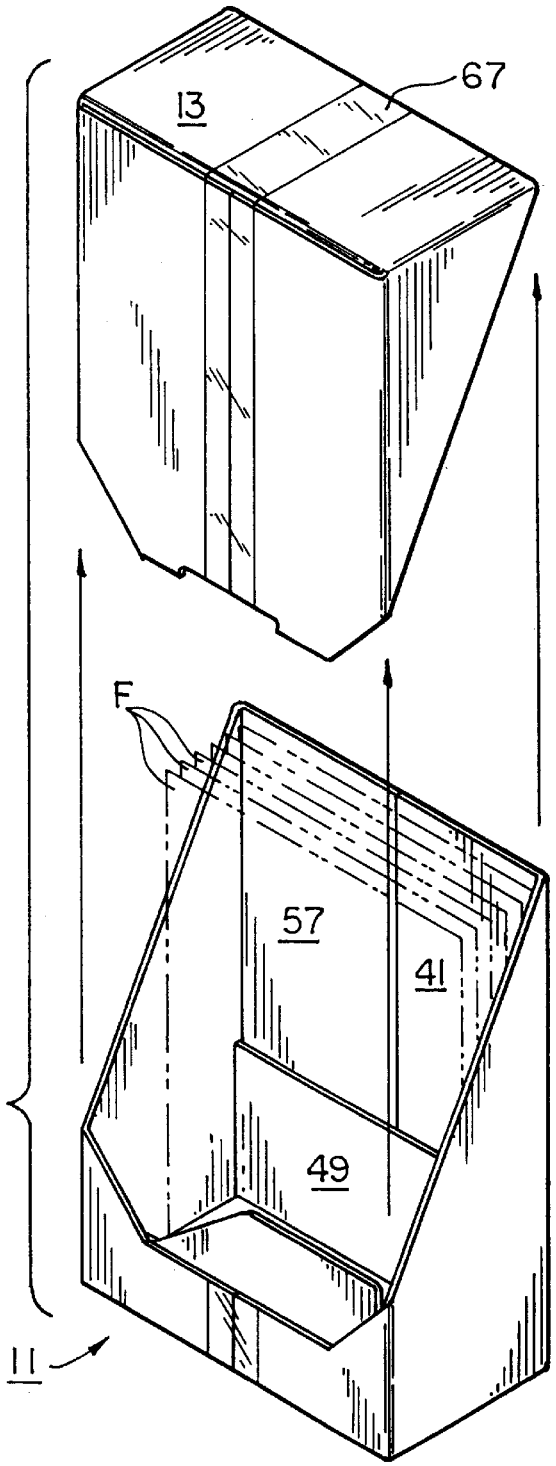
FIG. 6 is an exploded perspective view of the carton for shipping of FIG. 4, the carton being shown after the severance of the discarded top portion to form the carton for display of the present invention, the carton for display being shown holding a plurality of folders therewithin, the folders being shown in phantom.

With adhesive strip 67 severed in the aforementioned manner, carton 11 is then torn along the entire length of perforated tear lines 63 and 65, slots 46 and 62 serving to facilitate the initiation of the tearing along tear lines 63 and 65. As shown in FIG. 6, torn along tear lines 63 and 65, the upper portion of carton 11 is separated and can be discarded from the remainder of carton 11 which serves as the display of the present invention. Referring to blank 11 as shown in FIG. 1, the specific portion of carton 11 discarded to form the display of the present invention directly corresponds to the entire portion of blank 11 to the left of perforated tear line 63, the portion being identified generally by reference numeral 71, and the entire portion of blank 11 to the right of perforated tear line 65, the portion being identified generally by reference numeral 73.

As shown in FIG. 6, carton 11 for display is constructed to hold and display the particular articles held therewithin, such as a plurality of folders F. It should be noted that the particular size and shape of front panel 47 enables panel 47 to act as a restraining tab which serves to prevent folders F contained within from falling out from the front of carton 11. The size and shape of panel 47 also serves to enable the consumer to effectively view folder F for purchase.

The embodiment of the present invention described above is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A carton for use in the shipping and display of a plurality of articles, said carton being formed from a single-piece corrugated paperboard blank, said carton comprising:

(a). a top panel, a right side panel a bottom panel and a left side panel foldably connected together to form a box-shaped shipping carton having an open front and an open back, (b). a first pair of front flaps, one of said first pair of front flaps being foldably connected to each of said side panels, said first pair of front flaps being sized and shaped so as to close the open front of said shipping carton when folded, the front flap connected to said left side panel and the front flap connected to said right side panel each being shaped to define a slot, (c). a second pair of front flaps, one of said second pair of front flaps being foldably connected to said top panel and the other of said second pair of front flaps being foldably connected to said bottom panel, the front flap connected to said bottom panel being multisided, (d). a first pair of back flaps, one of said first pair of back flaps being foldably connected to each of said side panels, said first pair of back flaps being sized and shaped so as to close the open back of said shipping carton when folded, (e). a second pair of back flaps, one of said second pair of back flaps being foldably connected to said top panel and the other of said second pair of back flaps being foldably connected to said bottom panel, (f). a first, continuous, perforated tear line formed in said left side panel and in the front flap connected to said left side panel, said first tear line starting in said left side panel and terminating in the slot in the front flap connected to said left side panel, (g). a second, continuous, perforated tear line formed in said right side panel and in the front flap connected to said right side panel, said second continuous tear line being separate from said first continuous tear line, said second tear line starting in said right side panel and terminating in the slot in the front flap connected to said right side panel, and (h). said shipping carton being severable along said first and second tear lines to enable a portion of said shipping carton to be removed to convert said shipping carton to a display carton for the plurality of articles.

2. The carton as claimed in claim 1 further comprising a glue tab connected to said left side panel, said glue tab being secured to said top panel.

3. A blank for forming a carton, said blank being formed from a single-piece of corrugated paperboard, said blank being cut and scored to comprise:

(a). a top panel, a right side panel, a bottom panel and a left side panel consecutively connected, (b). four front flaps, one front flap being connected to each of said panels, the front flap connected to said bottom panel being multisided, the front flap connected to said left side panel and the front flap connected to said right side panel each being shaped to define a slot, (c). four back flaps, one back flap being connected to each of said panels, (d). a first, perforated, continuous tear line formed in said left side panel and in the front flap connected to said left side panel, said first tear line starting in said left side panel and terminating in the slot in the front flap connected to said left side panel, and (e). a second, perforated, continuous tear line formed in said right side panel and in the front flap connected to said right side panel, said second continuous tear line being separate from said first continuous tear line, said second tear line starting in said right side panel and terminating in the slot in the front flap connected to said right side panel.

4. The carton as claimed in claim 3 further comprising a glue tab connected to said left side panel.

* * * * *